United States Patent [19]

Richards et al.

[11] 4,190,985

[45] Mar. 4, 1980

[54] DOOR LOCKING ASSEMBLY

[75] Inventors: Lewis B. Richards, Oakland; Kenneth R. Romick, Hayward, both of Calif.

[73] Assignee: Washington Universal Security Products, Hayward, Calif.

[21] Appl. No.: 903,209

[22] Filed: May 5, 1978

[51] Int. Cl.[2] ..... E05B 47/00

[52] U.S. Cl. ..... 49/16; 49/18

[58] Field of Search ..... 49/15, 16, 18, 20

[56] References Cited

U.S. PATENT DOCUMENTS

| | | | |
|---|---|---|---|
| 2,148,521 | 2/1939 | Adam | 49/16 |
| 2,841,252 | 7/1958 | Adam | 49/16 |
| 3,271,901 | 9/1966 | Bednar | 49/18 X |
| 3,837,117 | 9/1974 | Butt | 49/18 |

*Primary Examiner*—Kenneth Downey

*Attorney, Agent, or Firm*—Owen, Wickersham & Erickson

[57] ABSTRACT

A locking assembly suitable for a plurality of sliding doors is disclosed. The assembly includes, at each door, a vertical drop bar in the door jamb with catches for engaging and locking the door at preferably two locations when the bar is lowered and the door is closed. The bar may be lifted by three different means: by a remotely operable motor which may be actuated to rotate a cam through one revolution, thereby lifting up on a rigid horizontal extension of the drop bar; by rotating a key in a key cylinder, which operates a similar rotatable cam to raise the bar; and by an emergency release mechanism including a manually slidable linkage member at the top of the frame, effective when its position is shifted to mechanically lift the drop bar. A deadlock is preferably provided to normally lock the bar in its lower, locking position, the deadlock being releasable upon actuation of any of the three drop bar lifting means. When the drop bar is lifted, mechanism is preferably provided to push the sliding door partially open and hold the bar in the raised position until the door is closed. Similar locking assemblies may be provided for a plurality of doors, with the motorized lock control effective for all doors from a single remote location, and with the emergency release mechanism effective to simultaneously unlock all of a row of doors.

21 Claims, 6 Drawing Figures

FIG. 5
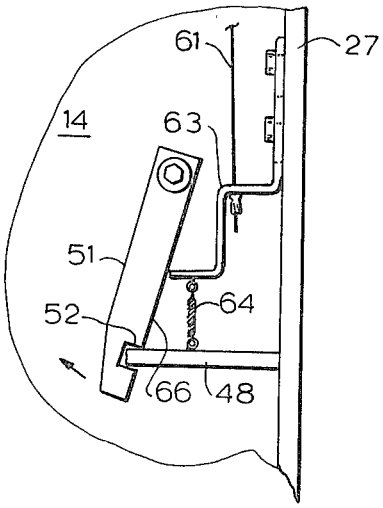
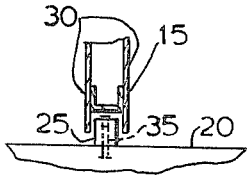
FIG. 6
FIG. 4
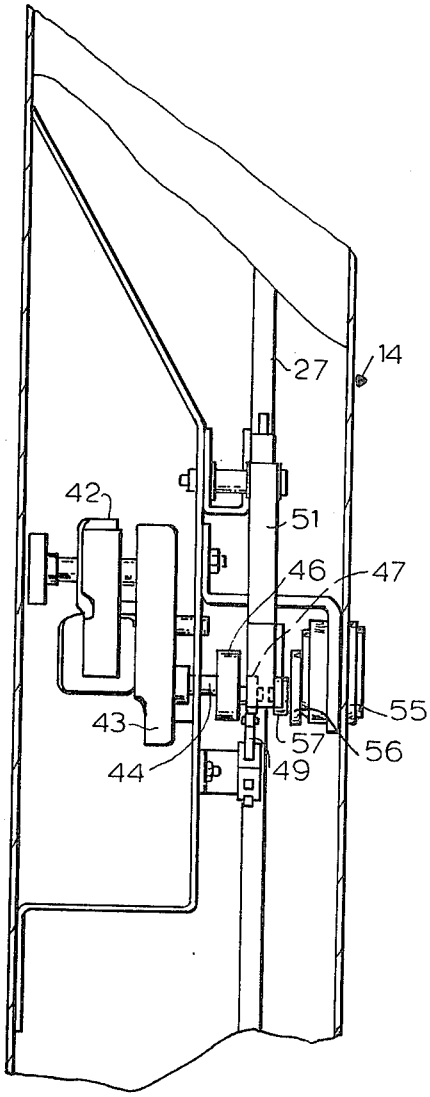
FIG. 3
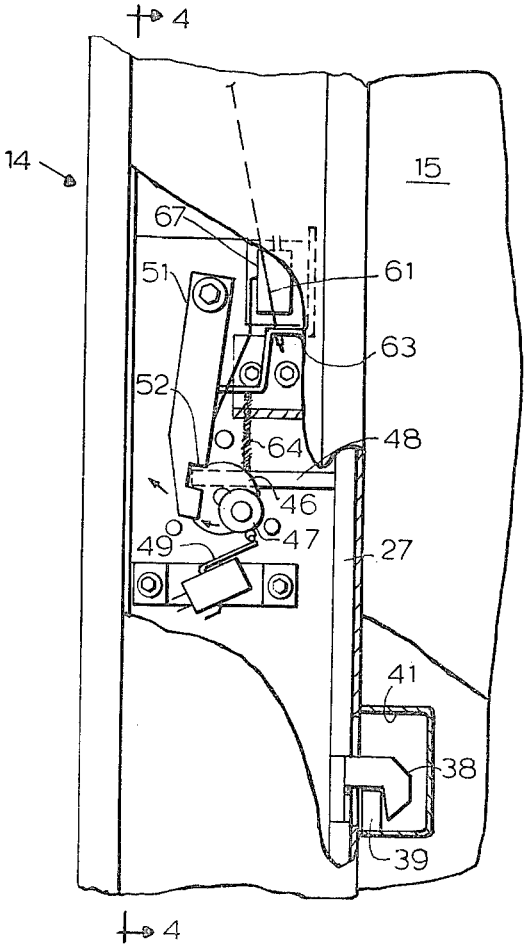

DOOR LOCKING ASSEMBLY

BACKGROUND OF THE INVENTION

The invention relates to door locking mechanisms, and more particularly to a locking assembly including a remotely operable motorized cam actuated lock control means.

Various types of door locking assemblies have previously been suggested, particularly in the field of multiple doors which are desirably controlled from remote locations, such as jail or prison doors. See, for example, U.S. Pat. Nos. 3,426,478, 3,792,888, 3,785,187 and 3,961,447. No previous door locking system, however has been as efficient and dependable, yet relatively simple in structure and operation, as the system of the present invention described below.

SUMMARY OF THE INVENTION

The present invention provides an improved, compact door locking assembly wherein the door, or an array of such doors as in a prison, may be unlocked from a single remote location, by electrical and mechanical means including a motor in the door jamb which lifts a locking drop bar by cam action. The door may also be unlocked by two other means, if desirable: a key cylinder in the door jamb, or an emergency release mechanism operable as a manual gang release for a bank of doors. The locking assembly is particularly suited for a sliding door.

The assembly may include two locks associated with the vertically movable drop bar, one located at the top of the door and one lower. In addition, a deadlock preferably holds the drop bar in its lower, locking position unless one of the three unlocking means is actuated. Lifting of the drop bar to the unlocking position preferably effects the partial opening of the door, with the bar retained in the upper position until the door is closed.

In one embodiment of the invention the locking assembly comprises a drop bar oriented generally vertically in the door jamb and slidably mounted therein between a lower locking position, with the bar having a door catch means for engaging and locking the door when the door is closed and the bar is lowered; a remotely operable electric motor means for lifting the drop bar and unlocking the door; a key cylinder for lifting the drop bar and unlocking the door; and emergency release means for manually and remotely lifting the drop bar to unlock the door.

It is therefore among the objects of the invention to provide an improved door locking assembly which is relatively simple in construction, occupying a small space in the door frame, but providing ample security and being operable efficiently and dependably from a remote location, with alternate unlocking means available if necessary. These and other objects, advantages and features of the invention will be apparent from the following description of a preferred embodiment, taken in conjunction with the accompanying drawings.

DESCRIPTION OF THE DRAWINGS

FIG. 3 is a cut-away frontal elevation view showing details of the locking assembly in the door jamb, with some components omitted for clarity.

FIG. 4 is a sectional elevation view taken along the line 4—4 of FIG. 3.

FIG. 5 is an enlarged detail elevation view showing a portion of the apparatus seen in FIG. 3.

FIG. 6 is a sectional view illustrating a lower door track assembly, taken along the line 6—6 of FIG. 1.

DESCRIPTION OF THE PREFERRED EMBODIMENT

Figure 1:
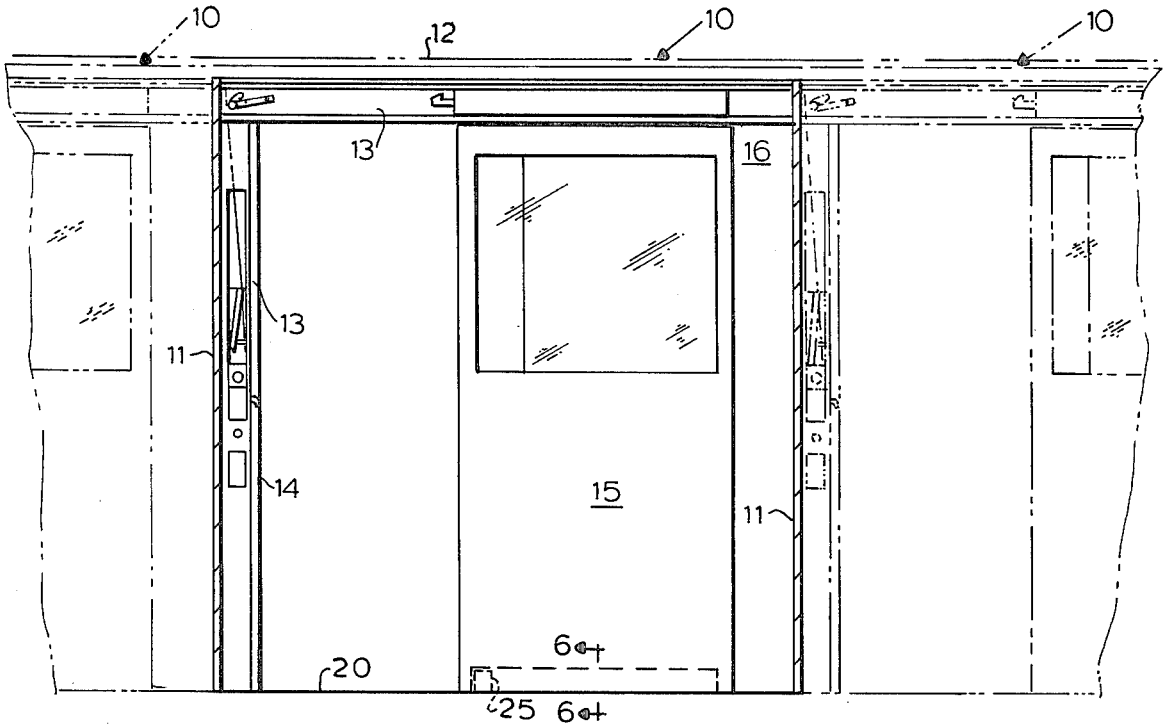
FIG. 1 is a frontal elevation view with some surfaces removed, showing a sliding door of a row of similar doors and indicating a locking assembly according to the invention.

FIG. 1 shows a row of sliding door assemblies 10, as in a jail, prison or other institution, with walls 11 between the compartments or cells, and also a ceiling 12, shown in section. Each door assembly includes a frame 13 including a jamb 14, the door 15 and an adjacent wall panel 16. Although the door 15 is illustrated and described as a sliding door, to which the apparatus of the invention is well adapted, it may also be a swinging door, and the invention encompasses such as application.

Door locking apparatus is included within the frame 13 and is described with reference to FIGS. 2 through 5.

Figure 2:
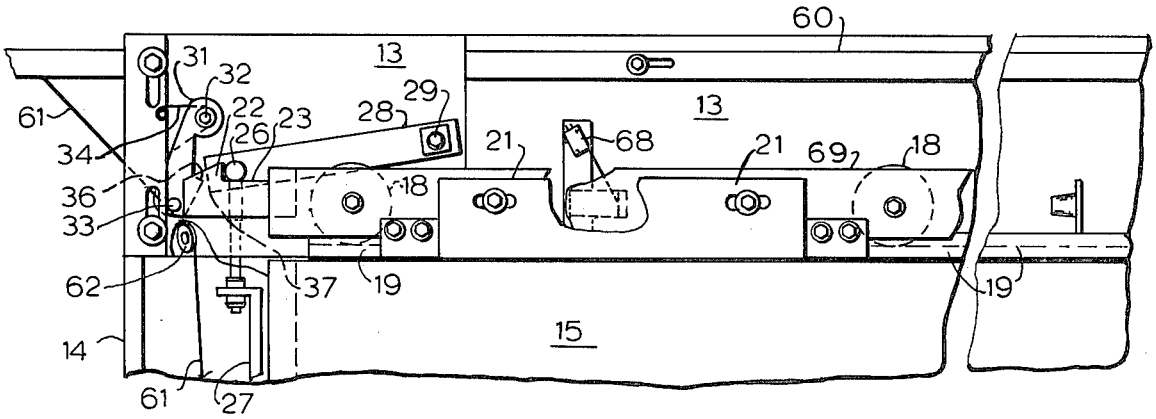
FIG. 2 is an enlarged, cut-away frontal elevation view indicating the mechanism of the locking assembly in the top of the door frame.

FIG. 2 shows a portion of the interior of the overhead portion of the frame 13. The door 15 has top rollers 18 which ride on a track 19 secured to the frame. An adjustable door hanger 21 secured to the door via a carriage bar 69, providing a mount for the rollers 18, has affixed to its forward end a catch blade 22 extending horizontally in the direction of the jamb. The catch blade 22 preferably has a notch 23 for providing an upper door lock. The upper door lock provides added security and is effected by the resting of a pin 26 in the notch 23, preventing the door 15 from sliding open (to the right in FIG. 2). The pin 26 is attached to the top of a drop bar 27 and is vertically movable from a lower (as shown) to an upper position therewith. Any suitable means may be used to guide the pin 26 and the top of the drop bar 27 in a substantially vertical path, a preferred device being a lever 28 pivoted to the frame 13 at 29, as shown.

A tamper-proof means for retaining the bottom of the sliding door 15 in place is illustrated in FIGS. 1 and 6. A guide block 25, secured to the floor or threshold 20 by any suitable means such as bolts or screws 35, is positioned between depending flanges 30 of the door, which define a central open channel for tracking over the block 25. As indicated in FIG. 1, the guide block 25 also preferably acts as a stop to limit the travel of the door in the opening direction. This lower track assembly is advantageous and significant in its simplicity, its invisibility and its total inaccessibility to one confined within a cell of which the assembly 10 forms a part.

The drop bar 27 is the central component of the door locking assembly. When in its lower position (shown in these drawings), it securely locks the closed door, preferably at two positions: at the catch blade 22 and also at a lower position on the jamb, described below. Encased within the jamb 14, the drop bar is inaccessible under ordinary circumstances and can only be lifted to its unlocking position by one of three means: a remote electrical control, a key, or a mechanical emergency release apparatus all of which are described below.

When the bar 27 is raised to unlock the door, it is preferably held in the raised position and the door is automatically opened partially. Both the opening of the door and the holding of the bar 27 in the upper position are accomplished through a spring loaded pusher 31. Pivoted from its upper end 32 to the frame 13, the pusher has a bearing pin 33 which bears against the end of the catch blade 22. Spring means such as shown at 34 constantly urges the pusher 31 toward the right, or counterclockwise rotation as viewed in FIG. 2. As it advances, moving the door, a ledge 36 on the pusher engages a projection 37 connected at least indirectly to the end of the drop bar 27. As indicated, the projection may comprise the end of the pivoted lever 28. When the projection is engaged, the drop bar 27 is retained in the lifted position, and as is apparent from FIG. 2, the bar will not again drop until the door is closed, moving the spring loaded pusher 31 back to its retracted position shown.

FIGS. 3 and 4 show lower portions of the door jamb 14, with the drop bar 27 extending down therethrough. A lock dog 38 is affixed to the movable drop bar and engages a catch 39 in a recess 41 of the door edge as shown. In the raised position of the drop bar, of course, the lock dog 38 (as well as the upper pin 26) clears the door and permits its opening.

A motorized drop bar lifting means is illustrated in FIGS. 3 and 4. A remotely operated motor 42, through a gear box 43, is operable to rotate a shaft 44 which rotates a rotatable cam means effective to lift the bar 27. The rotatable cam means may comprise a cam carrier 46 fixedly mounted on the shaft 44 and itself supporting rotatably an eccentrically mounted cam wheel 47. A rigid bar 48 (shown partially in dashed lines in FIG. 3 for clarity) extends from the drop bar 27 at a level just above the cam wheel 47 in the normal position of the cam wheel, when the drop bar is down as shown. The motor is set up to provide only one revolution of the cam carrier 46 at a time. This may be accomplished through a position sensor 49 which shuts off the motor at the right time so that the cam wheel 47 comes to rest in a lower position approximately as shown. If desirable, a braking means for the motor (not shown) of any conventional type may be included so that when the sensor 49 determines that the wheel 47 has reached the desired position, it effects the immediate stopping of rotation with the shutoff of the motor.

As seen in the drawings, a deadlock 51 may be provided to positively lock the drop bar 27 in its lower, locking position. A notch or stop ledge 52 in the edge of the pivoted deadlock arm 51 is urged toward engagement with the rigid bar 48, preferably by gravity as shown. Thus, the arm 51 must be swung away whenever the bar is to be raised. This is effected by the rotation of the cam carrier 46 with its cam wheel 47. The carrier 46 rotates clockwise as seen in FIG. 3, so that the cam wheel 47 first hits the arm 51 and swings it sufficiently out of the way then begins lifting the rigid bar 48 and drop bar 27. The end of the rigid bar 48 is clear of the ledge 52 before the cam wheel 47 moves out of engagement with the arm 51, and thence the bar 48 itself holds the arm 51 in upwardly rotated position. The bars 27 and 48 of course remain raised as long as the door remains open, so that the return of the cam wheel 47 to the position illustrated does not have the effect of lowering the drop bar.

The oblique inclination of the deadlock arm 51, which is freely pivoted to the door jamb from its upper end as shown, provides sufficient biasing force to assure that the stop ledge 52 falls into place over the rigid bar 48 whenever the drop bar falls to the locking position shown. However, a spring may be added if desired.

FIG. 4 illustrates a key cylinder 55 which is also effective to unlock the door. The cylinder functions in the same way as the motorized rotatable cam means, but independently thereof, to raise the drop bar 27. As shown in FIG. 4, it includes a rotatable cam carrier 56 similar to the motorized cam carrier 46, and an eccentrically mounted cam wheel 57 similar to the cam wheel 47. Each of the two cam wheels 47 and 57 operates on its own respective side of the deadlock arm 51 and of the rigid bar 48 (in FIG. 3 the cylinder 55 with the cam wheel 57 is omitted for clarity—the cam wheel 57 would be in front of the plane of what is shown in FIG. 3). The cylinder 55 is of course operable through one revolution of a key (not shown).

The third means by which the drop bar 27 may be lifted is through an emergency release apparatus including a slidable linkage member or master bar 60 (see FIG. 2) slidably mounted preferably on the overhead portion of the frame 13, and a flexible line 61 connected to the member 60 and extending over a pulley or other angle guide 62. From there the line 61 extends down to the drop bar 27 as shown in FIG. 3 and FIG. 5, which is an enlarged view of a portion of FIG. 3 with parts removed for clarity. The slidable linkage member 60 need not be a solid bar operable in compression to pull the tension line 61 as shown; it may alternatively be a flexible tension line. In either event the slidable linkage member 60 is operable manually from a point outside the enclosed area to which the door 15 relates, preferably from a remote location at the end of a row of such doors, to pull the line 61 and raise the drop bar 27 in an emergency event wherein electrical power is off and a key is not readily available. It thus may act as a manual gang release where there are a number of doors as in a jail or prison.

As FIGS. 4 and 5 indicate, the flexible line 61 is not connected directly to the drop bar 27, but rather to a lost motion device comprising a release bracket 63 which is slidably mounted see dashed lines indicating slots on the drop bar 27 for limited vertical movement with respect thereto. Normally the bracket 63 is at the lower end of its range of movement, retained in that position by a tension spring 64 pulling it toward the rigid bar 48. When the flexible tension line 61 is pulled, its initial movement pulls only the release bracket 63 upward, which acts on the adjacent inclined edge 66 of the deadlock arm 51 to push it outwardly (clockwise as seen in FIGS. 4 and 5), releasing the bar 48 from the stop ledge 52. Thus, when the release bracket reaches the upper limit of its movement on the bar 27, the bar 27 is free to rise with further movement of the line 61.

Various sensors, limit switches, etc. can be included in the door locking assembly of the invention for indicating at a central monitoring station the positions of each door, deadlock, drop bar, etc. For example, such sensors are shown at 67 and 68 (FIGS. 4 and 2). All circuitry serving such apparatus is conventional and does not form a part of the invention.

The above described preferred embodiment provides a door locking assembly which is normally operable electrically from a remote location, but also operable manually by key or by emergency gang release, and with other advantages such as relative simplicity, dependability and security. Various other embodiments and changes to this preferred embodiment will be apparent to those skilled in the art and may be made without departing from the spirit and scope of the invention as defined in the following claims.

We claim:

1. A locking assembly for a door installation including a frame, a door mounted for movement between an open and a closed position with respect to the frame, and a jamb associated with the frame at the side of the door where opening occurs, said locking assembly comprising:

locking means associated with the jamb and the adjacent edge of the door, including a lock dog portion associated with the jamb, protruding into the path of the door generally intermediate the top and bottom of the door and vertically movable from a lower locking position to an upper unlocking position;

a vertically oriented drop bar associated with the jamb and fixedly supporting the lock dog portion of the locking means, said drop bar being mounted on the jamb and within an enclosure associated with the jamb for up-and-down travel to move the lock dog portion between the locking and unlocking positions;

rotatable cam means for lifting the drop bar to raise the lock dog portion from locking to unlocking position; and remotely operable motor means for rotating the rotatable cam means to raise the drop bar and lock dog portion to unlocking position.

2. The locking assembly of claim 1 which further includes spring loaded reciprocable means associated with the frame for opening the door at least partially when the drop bar is lifted, said spring loaded reciprocable means also including engaging means for holding the drop bar in the upper unlocking position when lifted, until the door is closed.

3. The locking assembly of claim 1 which further includes reciprocable engaging means for holding the drop bar in the upper unlocking position when it is raised to such position, and means for retracting the engaging means and releasing the drop bar in response to closing of the door.

4. A locking assembly for a door installation including a frame, a sliding door mounted for sliding movement on a track attached to the frame between an open and a closed position with respect to the frame, and a jamb associated with the frame, said locking assembly comprising:

locking means associated with the jamb and the adjacent edge of the door, including a lock dog portion associated with the jamb and vertically movable from a lower locking position to an upper unlocking position;

a vertically oriented drop bar associated with the jamb and fixedly supporting the lock dog portion of the locking means, said drop bar being mounted on the jamb for up-and-down travel to move the lock dog portion between the locking and unlocking positions;

rotatable cam means for lifting the drop bar to raise the lock dog portion from locking to unlocking position;

remotely operable motor means for rotating the rotatable cam means to raise the lock dog portion to unlocking position; and means for holding the drop bar in the upper unlocking position when it is raised to such position and for releasing the drop bar in response to closing of the door, said drop bar holding and releasing means comprising a catch blade extending horizontally from the top of the door, toward the jamb, projection means associated with the top of the drop bar, and spring loaded pusher means mounted on the frame and engaged against the catch blade for pushing the catch blade and sliding the door partially open when the drop bar is lifted to unlock the door, said pusher means including means for engaging the projection means when the pusher means advances in opening the door, to hold the drop bar in the lifted position, said pusher means being operable to retract against spring pressure and release the drop bar when the door slides to the closed position with the catch blade bearing against the pusher means.

5. The locking assembly of claim 4 wherein said catch blade includes a notch in its upper edge, and the top of the drop bar includes a pin residing in the notch when the door is closed and locked, said notch and pin providing an upper door lock in addition to said locking means associated with the jamb and the door edge.

6. The locking assembly of claim 4 wherein said projection means associated with the top of the drop bar comprises one end of a pivoted lever to which the top of the drop bar is pivotally connected, the lever being pivoted to the frame at its other end.

7. The locking assembly of claim 4 wherein said spring loaded pusher means comprises an arm pivoted to the frame and oriented generally vertically, swingable in a plane generally parallel to the door, with a bearing pin on the end of the arm engaged against the end of the catch blade.

8. The locking assembly of claim 1, further including, in addition to the locking means associated with the jamb, upper door lock means associated with the top of the drop bar and the top of the door.

9. The locking assembly of claim 1, further including deadlock means for locking the drop bar in the lower, locking position, and means associated with the rotatable cam means for releasing the deadlock means just prior to lifting of the drop bar.

10. A locking assembly for a door installation including a frame, a door mounted for movement between an open and a closed position with respect to the frame, and a jamb associated with the frame, said locking assembly comprising:

locking means associated with the jamb and the adjacent edge of the door, including a lock dog portion associated with the jamb and vertically movable from a lower locking position to an upper unlocking position;

a vertically oriented drop bar associated with the jamb and fixedly supporting the lock dog portion of the locking means, said drop bar being mounted on the jamb for up-and-down travel to move the lock dog portion between the locking and unlocking positions;

rotatable cam means for lifting the drop bar to raise the lock dog portion from locking to unlocking positions; and remotely operable motor means for rotating the rotatable cam means to raise the lock dog portion to unlocking position, comprising a rigid bar extending transversely from the drop bar, a rotatable cam carrier driven by said motor means, and a cam wheel rotatably and eccentrically mounted on the cam carrier, said rigid bar being positioned just above and in the path of the cam wheel so as to be lifted thereby when the cam carrier rotates.

11. The locking assembly of claim 11, further including means associated with the motor and the cam wheel for sensing the position of the cam wheel and providing for one revolution of rotation when the motor is activated.

12. The locking assembly of claim 10, further including a key cylinder adjacent to the rotatable cam means and having a keyed rotatable cam means similar to the motor operated rotatable cam means, said keyed cam means having a keyed cam carrier and cam wheel similarly positioned with the rigid bar just above and in the path of the keyed cam wheel, so that the drop bar can be lifted by an operator's manual rotation of the key cylinder.

13. The locking assembly of claim 10, further including a deadlock for locking the drop bar in the lower, locking position, comprising an arm pivoted to the frame and having a stop ledge for engaging said rigid bar, said pivoted arm being biased toward engagement with the rigid bar and being in the path of the cam wheel so as to be pushed out of engagement from the rigid bar above the stop out of engagement while the cam carrier rotates to lift the rigid bar above the stop ledge toward the unlocked position.

14. The locking assembly of claim 13, further including a key cylinder adjacent to the rotatable cam means and having a keyed rotatable cam means similar to the motor operated rotatable cam means, said keyed cam means having a keyed cam carrier and cam wheel with the keyed cam carrier positioned directly opposite to and coaxial with the motor operated cam carrier, with the rigid bar just above and in the path of the keyed cam wheel and the pivoted arm to the side of and in the path of the keyed cam wheel, whereby the drop bar can be lifted to unlock the door by an operator's manual rotation of the key cylinder as well as by activation of the motor.

15. The locking assembly of claim 13, further including an emergency release mechanism comprising a slidable linkage member extending in proximity to the top of the door jamb, a flexible line secured to the slidable linkage member, a line guide mounted on the frame at the top of the jamb and supporting the line for angled movement thereover, and means connecting the line to the drop bar for releasing said pivoted arm of the deadlock upon initial movement of the slidable linkage member, then lifting the drop bar upon further movement of the slidable linkage member.

16. The locking assembly of claim 15 wherein said pivoted arm has an obliquely angled edge adjacent to the release bracket, with the arm pivoted from its upper end to the frame, said stop ledge being near the bottom end of the arm, and wherein said connecting means comprises a release bracket connected to the flexible line and mounted for limited vertical slidable movement on the drop bar, positioned to engage the pivoted arm above the stop ledge and to push the arm outwardly when the release bracket is raised, whereby initial movement of the slidable linkage member and the flexible line is effective to lift the release bracket with lost motion with respect to the drop bar, thereby releasing the pivoted arm of the deadlock, and further movement is effective to lift the release bracket and drop bar together toward the unlocked position.

17. The locking assembly of claim 15, wherein a plurality of doors are provided, each being mounted for sliding movement between the open and closed positions on a track attached to the frame, said slidable linkage member being continuous through proximity with the top of each door jamb, whereby the slidable linkage member functions as a mechanical gang release for the plurality of doors.

18. The locking assembly of claim 1, further including an emergency release mechanism comprising a master bar extending parallel to the top edge of the door, mounted for slidable longitudinal movement on the frame, a flexible line secured to the master bar, and a line guide mounted on the frame at the top of the jamb, said line extending obliquely from the master bar to the line guide and generally vertically down through the jamb to a connection with the drop bar.

19. The locking assembly of claim 1 wherein the door is a sliding door mounted for sliding movement on a track attached to the frame, and further including a door bottom guide and retaining assembly comprising a guide block secured to the floor and a channel extending longitudinally in the bottom edge of the door, part way through the length of the door, positioned in sliding relationship over the guide block.

20. The locking assembly of claim 19 wherein the guide block is positioned such that it acts as a stop limiting travel of the door in the opening direction.

21. A locking assembly for a door having a frame including a vertical door jamb, comprising: a drop bar oriented generally vertically in the door jamb, mounted for vertical sliding movement between a lower locking position and an upper unlocking position, said bar having at least one door catch means generally intermediate the top and bottom of the door for engaging and locking the door in the closed position of the door when the drop bar is in its lower locking position;

deadlock means for normally locking the drop bar in the lower locking position when the door is closed;

remotely operable electric motor means for lifting the drop bar and unlocking the door;

manually rotatable keyed cylinder means for lifting the drop bar upon rotation of the cylinder and unlocking the door;

emergency release means for manually and remotely lifting the drop bar and unlocking the door; and means associated with each of said three unlocking means for releasing the deadlock means prior to lifting of the drop bar.

* * * * *